US011170732B2

(12) United States Patent
Cheng

(10) Patent No.: US 11,170,732 B2
(45) Date of Patent: Nov. 9, 2021

(54) SMART MIRROR, DEVICE AND METHOD FOR CONTROLLING SCREEN STATE OF ELECTRONIC DEVICE, AND STORAGE MEDIUM

(71) Applicant: BOE Technology Group Co., Ltd., Beijing (CN)

(72) Inventor: Xinyi Cheng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/893,468

(22) Filed: Jun. 5, 2020

(65) Prior Publication Data

US 2021/0142759 A1 May 13, 2021

(30) Foreign Application Priority Data

Nov. 8, 2019 (CN) ..... 201911089821.6

(51) Int. Cl.
*G09G 5/00* (2006.01)

(52) U.S. Cl.
CPC ..... *G09G 5/00* (2013.01); *G09G 2330/023* (2013.01)

(58) Field of Classification Search
CPC ..... G09G 5/00; G09G 5/003; G09G 5/03; G09G 5/10; G09G 2330/023; G09G 2354/00; H04M 1/72454; H04M 1/72569; H04M 2250/12; G06F 9/451
See application file for complete search history.

(56) References Cited

U.S. PATENT DOCUMENTS 7,257,374 B1 * 8/2007 Creigh ..... H04B 17/318 455/41.2
2007/0218906 A1 * 9/2007 Melia ..... H04W 36/30 455/436

(Continued)

FOREIGN PATENT DOCUMENTS

CN 202929964 U 5/2013
CN 104363643 A 2/2015

(Continued)

OTHER PUBLICATIONS

First office action of Chinese application No. 201911089821.6 dated Sep. 2, 2021.

*Primary Examiner* — Ryan A Lubit
(74) *Attorney, Agent, or Firm* — Fay Sharpe LLP

(57) ABSTRACT

Provided are a smart mirror, a device and method for controlling a screen state of an electronic device, and a storage medium. The smart mirror includes: a radio frequency circuit, a screen, a memory and a processor; the processor is electrically connected to the radio frequency circuit, the screen and the memory respectively; at least one instruction executable by the processor is stored in the memory; and when the at least one instruction is executed by the processor, the processor is configured to: acquire a signal strength of at least one wireless signal detected by the radio frequency circuit; calculate a strength variation of the signal strength of the wireless signal relative to a reference signal strength of the wireless signal; and control the screen to be in an on state or an off state according to the strength variation.

12 Claims, 5 Drawing Sheets

(56) References Cited

U.S. PATENT DOCUMENTS

| | | | | |
|---|---|---|---|---|
| 2014/0137883 | A1* | 5/2014 | Rothschild | B26B 21/4056 132/200 |
| 2014/0325435 | A1* | 10/2014 | Jung | G06F 3/04845 715/790 |
| 2015/0066710 | A1* | 3/2015 | Waters | G06Q 10/087 705/28 |
| 2015/0220299 | A1* | 8/2015 | Kim | G06F 3/013 345/1.3 |
| 2016/0050518 | A1* | 2/2016 | Seo | H04M 1/72454 455/41.2 |
| 2017/0192486 | A1 | 7/2017 | Park et al. | |
| 2020/0074956 | A1* | 3/2020 | Zhou | H04M 1/72454 |
| 2020/0089306 | A1* | 3/2020 | Oh | G06F 1/3206 |

FOREIGN PATENT DOCUMENTS

| | | | |
|---|---|---|---|
| CN | 106850983 | A | 6/2017 |
| CN | 106850990 | A | 6/2017 |
| CN | 107102864 | A | 8/2017 |
| CN | 107221282 | A | 9/2017 |
| CN | 107948418 | A | 4/2018 |
| CN | 108333577 | A | 7/2018 |
| WO | WO2018210145 | A1 | 11/2018 |

* cited by examiner

SMART MIRROR, DEVICE AND METHOD FOR CONTROLLING SCREEN STATE OF ELECTRONIC DEVICE, AND STORAGE MEDIUM

This application claims priority to Chinese Patent Application No. 201911089821.6, filed before the National Intellectual Property Administration, PRC on Friday, Nov. 8, 2019 and titled "METHOD AND DEVICE FOR PREPARING DISPLAY DEVICE, DISPLAY DEVICE AND STORAGE MEDIUM", the entire contents of which are incorporated herein by reference.

TECHNICAL FIELD

The present disclosure relates to the field of display technology, more particularly, to an smart mirror, a device and method for controlling a screen state of the electronic device, and a storage medium.

BACKGROUND

In the related art, on or off of a screen may be controlled according to a distance between a user and the screen. For example, the distance between the user and the screen may be detected by proximity sensors such as infrared, ultrasonic, or the like. The screen is controlled to be turned on when the distance is less than a predetermined distance.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In some embodiments, a smart mirror is provided. The smart mirror includes: a radio frequency circuit, a screen, a memory and a processor, wherein the processor is electrically connected to the radio frequency circuit, the screen, and the memory respectively; at least one instruction executable by the processor is stored in the memory; and when the at least one instruction is executed by the processor, the processor is configured to: acquire a signal strength of at least one wireless signal detected by the radio frequency circuit; calculate a strength variation of the signal strength of the wireless signal relative to a reference signal strength of the wireless signal; and control the screen to be in an on state or an off state according to the strength variation.

In some embodiments, a device for controlling a screen state of an electronic device is provided. The device includes a memory and a processor, wherein at least one instruction executable by the processor is stored in the memory; and when the at least one instruction is executed by the processor, the processor is configured to: detect a signal strength of at least one wireless signal at a position of the screen; calculate a strength variation of the signal strength of the wireless signal relative to the reference signal strength of the wireless signal; and control the screen to be in an on state or an off state according to the strength variation.

In some embodiments, a method for controlling a screen state of an electronic device is provided. The method includes: detecting a signal strength of at least one wireless signal at a position of the screen; calculating a strength variation of the signal strength of the wireless signal relative to the reference signal strength of the wireless signal; and controlling the screen to be in an on state or an off state according to the strength variation.

In some embodiments, a non-transitory computer-readable storage medium is provided. The non-transitory computer-readable storage medium stores a computer program, wherein the computer program, when being executed by a processor, enables the processor to perform the method for controlling the screen state of the electronic device according to the first aspect of the present disclosure.

Additional aspects and advantages of the present disclosure are described in the following description, and would become apparent from the following description or would be understood by practicing the present disclosure.

BRIEF DESCRIPTION OF THE DRAWINGS

The above and/or additional aspects and advantages of the present disclosure may become apparent and easily understood from the following description of the embodiments with reference to the accompanying drawings, in which.

DETAILED DESCRIPTION

Figure 1:
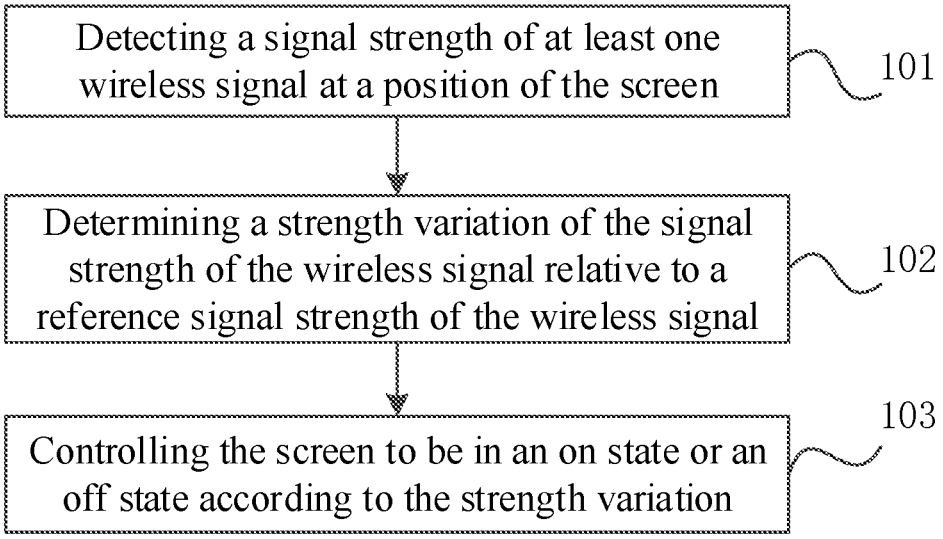
FIG. 1 is a schematic flowchart of a method for controlling a screen state of an electronic device according to an embodiment of the present disclosure.

Descriptions are made in detail to the embodiments of the present disclosure, examples of which are illustrated with reference to the accompanying drawings. Reference numerals which are the same or similar throughout the accompanying drawings represent the same or similar elements or elements with the same or similar functions. The embodiments described herein with reference to the accompanying drawings are intended to be illustrative only, and are not to be construed as limitations to the present disclosure.

For the electronic devices with display functions, such as a bathroom mirror, a hallway mirror, or the like, the screen of the electronic device may be directly controlled to be turned on or off by an external switch or a touch screen, or the screen may further be controlled to be turned on or off according to a distance between people and the screen of the electronic device, which is detected by infrared, ultrasonic and millimeter wave sensors. For example, when the distance is small, which indicates that there is someone in the vicinity of the screen, the screen may be controlled to be turned on to play a content; and when the distance is large, which indicates that there is no one in the vicinity of the screen, the screen may be controlled to be turned off to reduce power consumption.

However, for the first method of directly controlling the screen to turn on or off, personnel is required to perform a specific operation, for example, pressing the external switch, which is not convenient and low in intelligence level; and for the second method of detecting by the sensor, the state of the screen may be automatically controlled, but an additional related sensor is required, which is high in cost and low in adaptability due to that the state of the screen without the related sensor cannot be automatically controlled.

Mainly for the technical problems of high cost due to additional configuration of the related sensor and low adaptability due to that the state of the screen without the related sensor may not be automatically controlled in the related art, the present disclosure provides a method and device for controlling a screen state.

The embodiment of the present disclosure provides a method for controlling a screen state of an electronic device. The method includes: a signal strength of at least one wireless signal at a position of the screen is detected; a strength variation of the signal strength of the wireless signal relative to a reference signal strength of the wireless signal is calculated; and the screen is controlled to be in an on state or an off state according to the strength variation. Therefore, the screen state of the electronic device may be automatically controlled without configuring a related sensor in the screen, such that the cost of a product may be reduced, the method for controlling the screen may be enriched, and the applicability of the method may be improved or the adaptability of screen control may be enhanced.

The smart mirror, the device and method for controlling the state of the screen of the electronic device, and the storage medium according to the embodiment of the present disclosure will be described below with reference to the accompanying drawings.

FIG. 1 is a schematic flowchart of a method for controlling a screen state of an electronic device according to an embodiment of the present disclosure.

The method for controlling the state of the screen according to the embodiment of the present disclosure may be applied to the electronic device, such that the electronic device may perform a screen state control function.

The electronic device refers to a device with a display function. For example, the electronic device may be hardware devices with various operating systems, touch screens and/or display screens, such as a mobile phone, a tablet computer, a personal digital assistant, a wearable device, or the like; or the electronic device may further be a smart mirror with a display function, such as a bathroom mirror, a hallway mirror, or the like, which is not limited by the present disclosure.

As shown in FIG. 1, the method for controlling the state of the screen may include the following steps:

In step 101, a signal strength of at least one wireless signal at a position of the screen is detected.

For example, the wireless signal may be a Bluetooth (BT) signal, a wireless fidelity (WiFi) signal, or the like. Signal intensities of different wireless signals may be detected by corresponding radio frequency circuits. For example, the signal strength of the Bluetooth signal is detected by a Bluetooth module, and the signal strength of the WiFi signal is detected by a WiFi module.

Optionally, step 101 may be performed periodically, and a time interval for each performance may be predetermined or preset by user before performing the method, for example 1 s, 2 s, 3 s, or the like, which is not limited by the present disclosure.

In step 102, a strength variation of the signal strength of the wireless signal relative to the reference signal strength of the wireless signal is calculated.

In the first possible implementation, the reference signal strength is a signal strength by which the wireless signal is transmitted to the screen under the condition that no target object is present within a predetermined range around the screen. In this case, the reference signal strength may be acquired by field measurement, that is, after the screen is placed at a designated position, the signal strength of at least one wireless signal at the position of the screen is detected under the condition that no target object present within a predetermined range around the screen, and the reference signal strength is calculated according to the detected signal strength of the wireless signal.

It should be noted that the signal strength of the wireless signal has a certain variability, for example, the strength signal of the wireless signal accords with Gaussian distribution; therefore, as a possible implementation, a mathematical expectation value of the signal strength of the wireless signal under the condition that no target object is present within a predetermined range around the screen may serve as the reference signal strength of the wireless signal. For example, the mathematical expectation value of the signal strength of the wireless signal under the condition that no target object present within a predetermined range around the screen may be acquired by the following way: for the wireless signal, the mathematical expectation value of the signal strength may be calculated according to each detected signal strength at the position of the screen under the condition that no target object is present within a predetermined range around the screen, for example, a corresponding signal strength may be acquired at each sampling time, a corresponding mathematical expectation value is calculated according to the signal strength acquired by sampling, and the mathematical expectation value serves as the reference signal strength of the wireless signal.

For example, in the embodiment of the present disclosure, the expression "within a predetermined range around the screen" refers to "within a predetermined region in front of the screen", for example, the region may be of a rectangle, a fan shape or a trapezoid taking a side, proximal to a bottom surface, of the screen as a side and going distally from the screen. The target object may be a human, that is, a user of the electronic device. It should be noted that the following will perform illustrative explanation by taking whether there is someone in the vicinity of the screen as an example of whether a target object is present within a predetermined range around the screen.

In some embodiments, the signal strength of the wireless signal at the position of the screen may be detected at a predetermined time period, wherein a length of the predetermined time period may be predetermined according to actual requirements, for example, 5 minutes, 10 minutes, or the like, which is not limited by the present disclosure.

In some embodiments, a starting point of the predetermined time period may be a time when a designated operation of a user is detected, for example, a time when the electronic device receives an operation instruction of the user by a remote control device, wherein the operation instruction is intended to instruct the remote control device to acquire a standard signal value. Since the user may send out the operation instruction by the remote control device when being far away from the screen, the time when the operation instruction transmitted by the remote control device is received may serve as a starting point of the predetermined time period.

In some embodiments, a starting point of a predetermined time period may be a certain time of a predetermined duration after detection of the designated operation of the user. For example, the electronic device receives the operation instruction of the user by a switch on the electronic device, wherein the operation instruction is intended to instruct the remote control device to acquire a standard signal value. Since it is necessary to detect the strength of the wireless signal when there is no one in the vicinity of the electronic device, a predetermined duration (for example 1 to 2 minutes) is reserved, such that the user may be distal from the electronic device after operating the switch.

In some embodiments, the state that no one is in the vicinity of the screen is identified according to the operation instruction of the user; and in another implementation, whether there is someone in the vicinity of the screen may also be judged by the screen state at a certain time period in one day, for example, the state that no one is in the vicinity of the screen may be calculated when the screen is in an off state and during night (for example 12:00 a.m. to 4:00 a.m.), and a mean value of the signal strength of the wireless signal detected within the time period serves as the reference signal strength. Or, in yet another implementation, the signal strength of the wireless signal may be continuously detected and recorded. Since there is no one in front of the smart mirror in most cases, the mathematical expectation value of the signal strength of the wireless signal will tend to be the strength of the wireless signal under the state that no one is in the vicinity of the screen when the sampling times of the signal strength of the wireless signal are sufficient; and in this case, the mathematical expectation value of the signal strength of the wireless signal may be updated periodically.

In some embodiments, the reference signal strength may be preconfigured, for example, the reference signal strength may be configured before products leave the factory and may be an empirical value.

It can be understood that, according to an influence principle on the signal strength by propagation attenuation, shielding and multipath effect of the wireless signal, the signal strength of the wireless signal received at the position of the screen may vary obviously when there is someone in the vicinity of the screen; therefore, in the present disclosure, whether there is someone in the vicinity of the screen may be judged according to the signal strength of the wireless signal detected at the position of the screen, such that the screen state of the screen is controlled according to the judgment result.

In different indoor environments such as houses or offices, the signal strength of the wireless signal is different everywhere, the reference signal strength is acquired by field measurement at the position of the screen, and predetermination of the reference signal strength may be more in accordance with the actual environment where the screen is located, such that whether there is someone in the vicinity of the screen may be accurately judged according to the reference signal strength. Furthermore, the preconfigured reference signal strength may be directly put into use without debugging the electronic device, thus simplifying the use process.

In step 102, a strength variation may be calculated by comparing the detected signal strength of the wireless signal with the corresponding reference signal strength of the wireless signal, wherein the strength variation may be an absolute variation of the strength, or may be a relative variation of the strength, which is not limited by the embodiment of the present disclosure.

For example, the monitored signal strength of the wireless signal is marked as S1, the reference signal strength is marked as S0, the absolute variation of the strength is marked as |S1−S0|, and the relative variation of the strength is marked as |S1−S0|/S0.

In step 103, the screen is controlled to be in an on state or an off state according to the strength variation.

In some embodiments, step 103 may include: the screen is controlled to be in an on state in response to identifying the strength variation is greater than a strength variation threshold; the screen is controlled to be in an off state in response to identifying the strength variation is not greater than the strength variation threshold, or the screen state of the electronic device is controlled to be in an off state in response to identifying that the strength variation calculated within the predetermined duration is not greater than the strength variation threshold and the screen state of the screen is in an on state within the predetermined duration.

It should be noted that in the embodiment of the present disclosure, controlling the screen to be in an on state is practiced under two conditions: the screen state is maintained to be unchanged, namely the on state, in response to identifying the current screen state is the open state, and the screen state is changed from the off state to the on state in response to identifying the current screen state is the off state. Similarly, controlling the screen to be in an off state further is practiced under two conditions: the screen state is maintained to be unchanged, namely the off state, in response to identifying the current screen state is the off state, and the screen state is changed from the on state to the off state in response to identifying the current screen state is the on state.

It should be noted that when there is someone in the vicinity of the screen, the signal strength of the wireless signal detected at the position of the screen may obviously vary and the strength variation is large; and when there is no one in the vicinity of the screen, the signal strength of the wireless signal detected at the position of the screen should be within a predetermined range and a difference value between the signal strength and the reference signal strength is small, that is, the strength variation is small. Therefore, in the embodiment of the present disclosure, the screen state of the screen may be controlled according to the strength variation. For example, the screen state may be controlled to be an on state when the strength variation is large, and the screen state may be controlled to be an off state when the strength variation is small. Therefore, the screen state of the electronic device can be automatically controlled without configuring an additional sensor, such that the cost may be reduced. Furthermore, the screen state is controlled according to the strength variation, such that the method for controlling the screen may be enriched, and the applicability of the method may be improved or the adaptability of screen control may be enhanced.

As an application scenario, taking a wireless signal being a WiFi signal and a display device being a smart mirror as an example, a radio frequency circuit, such as a WiFi module, in the smart mirror may detect the signal strength of a router in the surrounding environment, and whether there is someone in the vicinity of the smart mirror is calculated according to the detected signal strength, thereby automatically controlling the on and off states of the screen.

In the method for controlling the screen state according to the embodiment of the present disclosure, the strength of the wireless signal at the position of the screen is detected, the strength variation of the signal strength of the wireless signal relative to the reference signal strength of the wireless signal is calculated, and the screen state of the screen is controlled to be an on state or an off state according to the strength variation. Therefore, the screen can be automatically controlled without configuring an additional related sensor in the screen, such that the cost may be reduced, the method for controlling the screen may be enriched, and the applicability of the method may be improved or the adaptability of screen control may be enhanced.

It should be noted that during actual application, the number of the wireless signals detected at the position of the screen may be one or more. When there are a plurality of wireless signals, the strength variation of each wireless signal may be calculated in step 103, and a corresponding weight may be calculated according to the wireless signal of which the strength variation is large, thereby controlling the screen state of the screen according to the calculated weight. The above process is described hereinafter in detail with reference to an embodiment as shown in FIG. 2.

Figure 2:
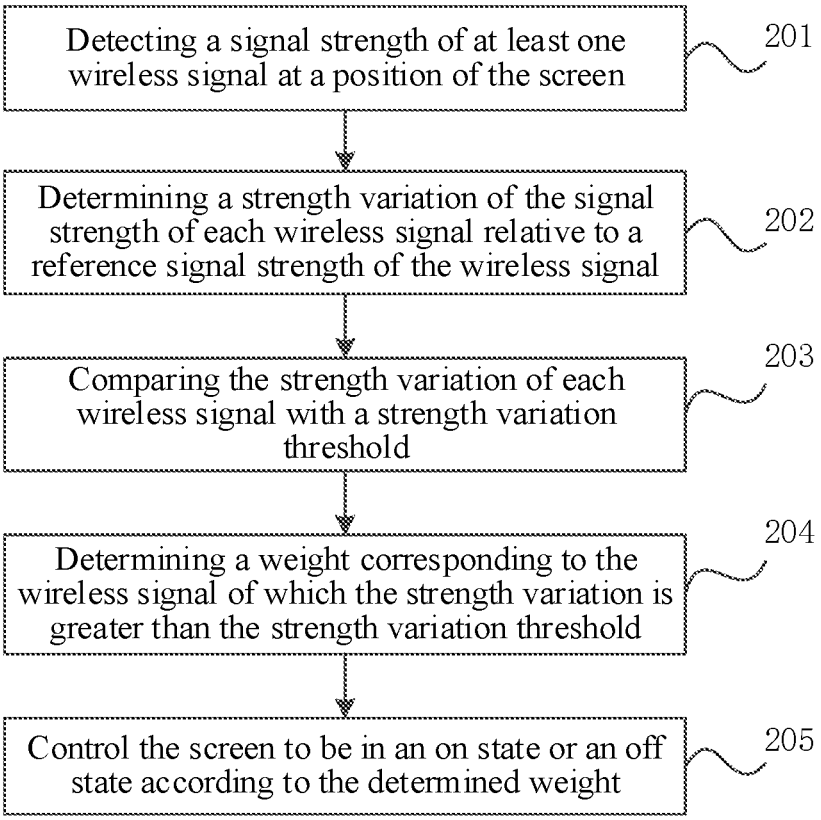
FIG. 2 is a schematic flowchart of a method for controlling a screen state of an electronic device according to an embodiment of the present disclosure.

FIG. 2 is a schematic flowchart of a method for controlling a screen state according to an embodiment of the present disclosure.

As shown in FIG. 2, the method for controlling the screen state may include the following steps:

in step 201, a signal strength of at least one wireless signal at a position of the screen is detected.

In the embodiment of the present disclosure, the signal strength of each wireless signal may be calculated respectively when the number of the wireless signals which can be detected at the position of the screen is at least two.

In the embodiment of the present disclosure, step 201 may be performed only when the screen is in the off state, and accordingly, the method for controlling the screen state is intended to control the screen to be automatically turned on; or step 201 may be performed only when the screen is in the on state, and accordingly, the method for controlling the screen state is intended to control the screen to be automatically turned off; or step 201 may be performed when the screen is in the on or off state, and accordingly, the method for controlling the screen state is intended to control the screen to be automatically turned off or turned on.

In step 202, a strength variation of the signal strength of each detected wireless signal relative to the reference signal strength of the wireless signal is calculated.

For example, for each wireless signal, a mathematical expectation value of the signal strength of the wireless signal detected at the position of the screen may serve as the reference signal strength of the wireless signal under the state that no one is in the vicinity of the screen.

In some embodiments, a first mathematical expectation value may be recorded as the reference signal strength of the corresponding wireless signal; wherein the first mathematical expectation value is a mathematical expectation value of the signal strength of each wireless signal detected at the position of the screen under the state that no one is in the vicinity of the screen.

For example, for each wireless signal, a mathematical expectation value of the signal strength may be calculated according to each signal strength of the wireless signal detected when there is no one in the vicinity of the screen, for example, the corresponding signal strength of the wireless signal may be acquired at each sampling time, a first mathematical expectation value corresponding to the wireless signal may be calculated according to the signal strength acquired by sampling, and the first mathematical expectation value serves as the reference signal strength of the wireless signal.

The method of detecting the signal strength of the wireless signal at the position of the screen when there is no one in the vicinity of the screen may be referenced to step 102, and detailed description will be not given herein.

In the embodiment of the present disclosure, for each wireless signal, the strength variation of the wireless signal may be calculated by comparing the signal strength of the wireless signal with the corresponding reference signal strength of the wireless signal.

For example, when the wireless signal is a WiFi signal, the electronic device may correspondingly store service set identifiers (SSID) and reference signal intensities of various WiFi signals in advance, such that during actual application, when the signal strength of each WiFi signal is acquired, the corresponding reference signal strength may be inquired and acquired according to the SSID of the WiFi signal, and the strength variation of the WiFi signal is calculated by comparing the signal strength of the WiFi signal with the corresponding reference signal strength of the WiFi signal.

In step 203, the strength variation of each wireless signal is compared with a strength variation threshold.

In step 204, a corresponding weight is calculated for the wireless signal of which the strength variation is greater than the strength variation threshold.

In the embodiment of the present disclosure, the strength variation threshold is calculated according to a mean square deviation of each wireless signal detected under the state that no one is in the vicinity of the screen.

In some embodiments, a product of a first mean square deviation of each wireless signal and a predetermined multiple may serve as a strength variation threshold of the corresponding wireless signal, wherein the value of the predetermined multiple may be 1 or 2, and the first mean square deviation is a mean square deviation of the signal strength of the corresponding wireless signal detected under the state that no one is in the vicinity of the screen.

For example, for each wireless signal, the corresponding mean square deviation may be calculated according to each signal strength of the wireless signal detected at the position of the screen under the state that no one is in the vicinity of the screen, and is recorded as a first mean square deviation according to the present disclosure, that is, the first mean square deviation is a mean square deviation of the signal strength of the corresponding wireless signal detected under the state that no one is in the vicinity of the screen. For example, the first mean square deviation is marked as $\sigma_1$.

For example, the strength variation threshold may be predetermined to have over 95% of probability of falling into a Gaussian distribution interval, that is, only 5% probability that the strength variation of the wireless signal accords with the strength variation threshold under the state that no one is in the vicinity of the screen; therefore, the strength variation threshold may be calculated to be reasonable and effective under the state that someone is in the vicinity of the screen and when the strength variation is greater than the strength variation threshold. At this time, the strength variation threshold may be twice the first mean square deviation, that is, the strength variation threshold is $2\sigma_1$.

In the embodiment of the present disclosure, for each wireless signal, the corresponding strength variation of the wireless signal may be compared with the strength variation threshold of the wireless signal after the corresponding strength variation of each wireless signal is calculated; the corresponding signal strength of the wireless signal may be discarded in response to identifying the strength variation is less than or equal to the corresponding strength variation threshold; and a corresponding weight of the wireless signal is inquired in response to identifying the strength variation is greater than the corresponding strength variation threshold, wherein the weight corresponding to each wireless signal is intended to indicate the probability that someone is in the vicinity of the screen when the strength variation of the corresponding wireless signal is greater than the strength variation threshold. For example, for each wireless signal, a second mathematical expectation value of the signal strength of the detected wireless signal may be calculated in advance under the state that someone is in the vicinity of the screen, and the weight of the wireless signal is calculated according to the first mathematical expectation value, the second mathematical expectation value and the first mean square deviation corresponding to the wireless signal, that is, in the present disclosure, the corresponding weight of each wireless signal may be calculated in advance under the state that someone is in the vicinity of the screen. Herein, the method of calculating the second mathematical expectation value may be the same as the method of calculating the first mathematical expectation value, which will not be elaborated herein.

In step 205, the screen is controlled to be in an on state or an off state according to the calculated weight.

In some embodiments, step 205 may include:

controlling the screen to be in the on state in response to identifying a sum of the calculated weights is greater than a weight threshold, wherein the weight threshold is preset, for example, the weight threshold may be calculated during factory debugging, for example, the weight threshold may be 0.6.

In the embodiment of the present disclosure, in the case where the sum of the calculated weights is greater than the weight threshold, it may be identified that someone is in the vicinity of the screen and the screen may be controlled to be in the on state at this time. However, in the case where the sum of the calculated weights is not greater than or is equal to the weight threshold, no processing may be done in order to reduce the probability of false trigger.

In some embodiments, step 205 may include: controlling the screen to be in the off state in response to identifying the sum of the calculated weights is not greater than the weight threshold; or controlling screen to be in the off state in response to identifying the sum of the calculated weights is not greater than the weight threshold within a predetermined duration and the screen is in the on state within the predetermined duration.

Here, a length of the predetermined duration may be predetermined or preset by user before performing the method.

It should be noted that in the embodiment of the present disclosure, controlling the screen to be in an on state is practiced under two conditions: the screen state is maintained to be unchanged, namely the on state, in response to identifying the current screen state is the open state; and the screen state is changed from the off state to the on state when the current screen state is the off state. Similarly, controlling the screen to be in an off state is practiced under two conditions: the screen state is maintained to be unchanged, namely the off state, in response to identifying the current screen state is the off state; and the screen state is changed from the on state to the off state in response to identifying the current screen state is the on state.

Based on the method for controlling the screen state according to the embodiment of the present disclosure, the screen may be automatically controlled without configuring an additional related sensor. Therefore, the cost may be reduced, the method for controlling the screen may be enriched, and the applicability of the method may be improved or the adaptability of screen control may be enhanced.

In some embodiments, since the signal strength of the wireless signal has a certain variability, in order to calculate a weight corresponding to each wireless signal, the weight may be calculated by a confidence degree for representing the stability of each wireless signal as well as a first mathematical expectation value and a first mean square deviation of the signal strength of each wireless signal detected under the state that no one is in the vicinity of the screen. The above process is described herein in detail with reference to an embodiment as shown in FIG. 3.

Figure 3:
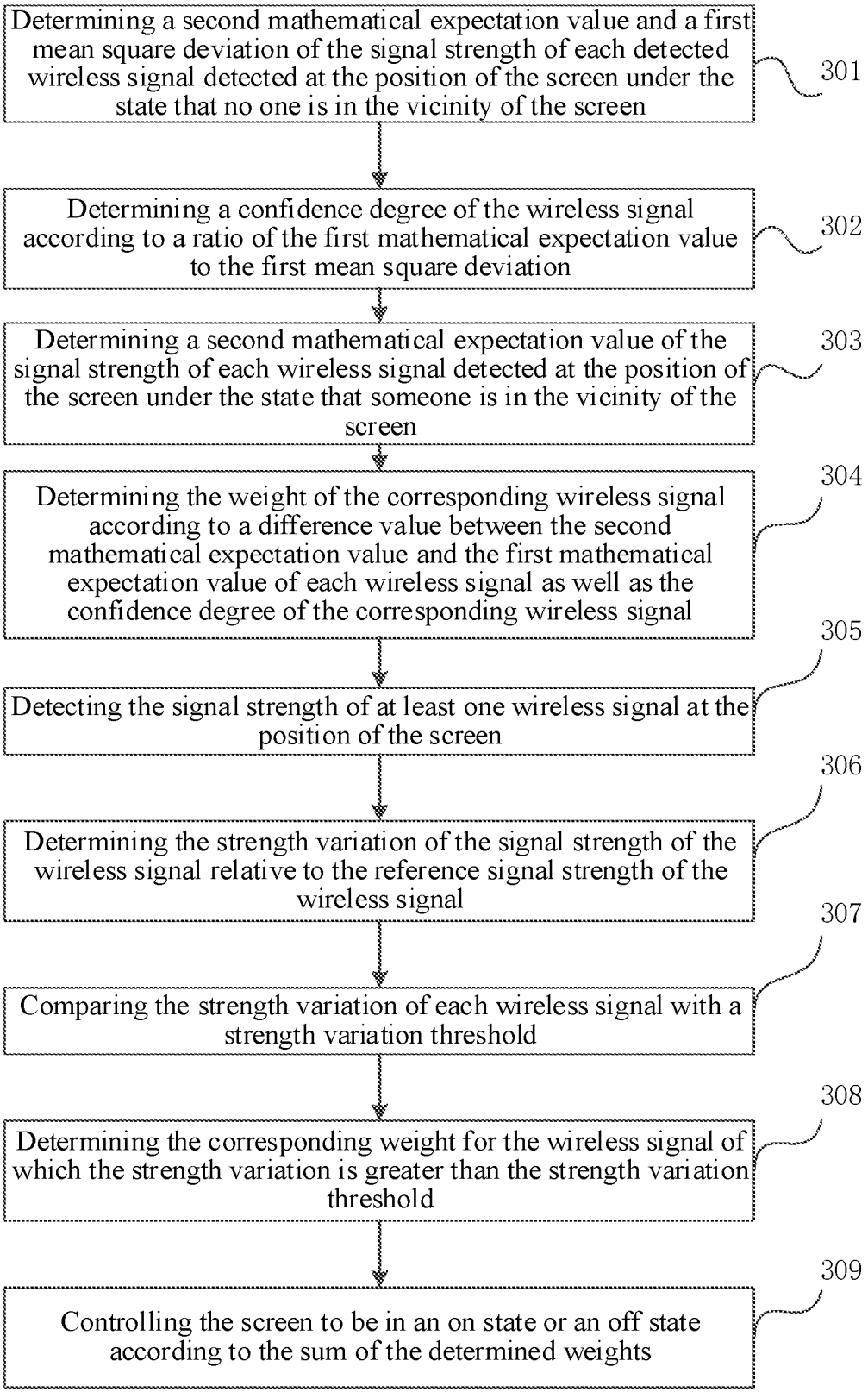
FIG. 3 is a schematic flowchart of a method for controlling a screen state of an electronic device according to an embodiment of the present disclosure.

FIG. 3 is a schematic flowchart of a method for controlling a screen state of an electronic device according to an embodiment of the present disclosure.

As shown in FIG. 3, the method for controlling the screen state may include the following steps:

In step 301, a first mathematical expectation value and a first mean square deviation of the signal strength of each wireless signal detected at the position of the screen is calculated under the state that no one is in the vicinity of the screen.

Specifically, in this step, a method of calculating that no one is in the vicinity of the screen and calculating the first mathematical expectation value and the first mean square deviation may be referenced to step 202, and detailed description is not given herein.

In step 302, a confidence degree of the corresponding wireless signal is calculated according to a ratio of the first mathematical expectation value to the first mean square deviation.

Herein, the confidence degree is intended to indicate the stability of the corresponding wireless signal.

It should be understood that the greater the signal strength of the wireless signal is, the more important the wireless signal is, that is, the more likely the electronic device is to be connected to the wireless signal, and the smaller the mean square deviation of the signal strength of the wireless signal is, which indicates that the higher the stability of the wireless signal is, the higher the important degree is. Therefore, in the embodiment of the present disclosure, the confidence degree of the wireless signal may be calculated according to the first mathematical expectation value and the first mean square deviation of the signal strength of the wireless signal.

For example, for each wireless signal, the ratio of the first mathematic expectation value to the first mean square deviation of the signal strength of the wireless signal may serve as the confidence degree of the wireless signal. For example, the first mathematical expectation value is marked as $\mu_1$, the first mean square deviation is marked as $\sigma_1$, the confidence degree is marked as $\tau$, then $\tau=\mu_1/\sigma_1$.

It should be noted that in other embodiments, the ratio of the first mathematical expectation value to the first mean square deviation may not serve as the confidence degree, as long as a relationship that the confidence degree is directly proportional to the first mathematical expectation value and is inversely proportional to the first mean square deviation is met.

Alternatively, for each wireless signal, a ratio of the first mathematical expectation value to a first square deviation of the signal strength of the wireless signal may further serve as a confidence degree of the wireless signal, then $\tau=\mu_1/\sigma_1^2$, wherein $\sigma_1^2$ represents the first square deviation.

In step 303, a second mathematical expectation value of the signal strength of each wireless signal detected at the position of the screen is calculated under the state that someone is in the vicinity of the screen.

In order to improve the accuracy of identifying the state that someone is approaching, identification may be performed according to an interaction operation of the user and the electronic device. For example, when the electronic device detects the interaction operation, it is identified as the state that someone is approaching, for example, the user may actively turn on the screen and interact with the screen. Therefore, step 303 may include: calculating the second mathematical expectation value of the signal strength of each detected wireless signal in response to the received interaction operation, wherein the interaction operation represents that someone is the vicinity of the screen.

In some embodiments, step 303 may include: calculating the second mathematical expectation value of the signal strength of each detected wireless signal in response to a detection signal output by a detection device, wherein the detection signal is intended to indicate that someone is in the vicinity of the screen.

Optionally, the detection device includes but not limited to infrared, laser and millimeter wave sensors, or a sensor group (such as a microphone group) for collecting audio information in the environment, or the like. Whether an object in the vicinity of the screen is the target object, for example whether there is someone, may be calculated by information collected by the sensor or information collected by the sensor group.

In the embodiment of the present disclosure, the second mathematical expectation value of the signal strength of each wireless signal detected at the position of the screen is calculated under the state that someone is in the vicinity of the screen. For example, for each wireless signal, a mathematical expectation value may be calculated according to each signal strength of the detected wireless signal when someone is in the vicinity of the screen, for example, the signal strength corresponding to the wireless signal may be acquired at each sampling time, and the second mathematical expectation value corresponding to the wireless signal may be calculated according to the signal strength acquired by sampling.

In step 304, a weight of the corresponding wireless signal is calculated according to a difference value between the second mathematical expectation value and the first mathematical expectation value of each wireless signal as well as the confidence degree of the corresponding wireless signal.

In the embodiment of the present disclosure, the difference value between the second mathematical expectation value and the first mathematical expectation value of each wireless signal is intended to indicate the variation magnitude of the signal strength of the state that there is someone relative to the state that there is no one, and representing a sensitive degree of the wireless signal on the event of whether there is someone in the vicinity of the screen.

In the embodiment of the present disclosure, for each wireless signal, the weight of the wireless signal may be calculated according to the difference value between the second mathematical expectation value and the first mathematical expectation value of the wireless signal as well as the confidence degree of the wireless signal. For example, the second mathematical expectation value is marked as $\mu_2$, and the weight of the wireless signal may be calculated according to the following formula: $(\mu^2-\mu_1)*\tau$.

Optionally, the weight of each wireless signal may further be normalized. For example, the weights of all the wireless signals may be added to serve as a denominator, the weight of the wireless signal may serve as a numerator for each wireless signal, and the normalized weight of the wireless signal may be acquired by dividing the numerator by the denominator.

For example, the normalized weight corresponding to an $i^{th}$ wireless signal is:

$$\frac{(\mu_{i2}-\mu_{i1})*\tau_i}{\sum_{k=0}^{n}(\mu_{k2}-\mu_{k1})*\tau_k},$$

wherein $\mu_{i2}$ represents the second mathematical expectation value of the $i^{th}$ wireless signal, $\mu_{i1}$ represents the first mathematical expectation value of the $i^{th}$ wireless signal, $\tau_i$ represents the confidence degree of the $i^{th}$ wireless signal, and n represents the number of the wireless signals.

In some embodiments, in order to reduce the calculation workload, the wireless signal in which the difference value between the second mathematical expectation value and the first mathematical expectation value is greater than the strength variation threshold of the corresponding wireless signal may only be calculated, and the weight of the wireless signal may be calculated according to step 304.

In step 305, the signal strength of at least one wireless signal at a position of the screen is detected.

The related content of step 305 may be referenced to step 101, which is not elaborated herein.

In step 306, the strength variation of the signal strength of the wireless signal relative to the reference signal strength of the wireless signal is calculated.

In step 307, the strength variation of each wireless signal is compared with the strength variation threshold.

In step 308, the corresponding weight is calculated for the wireless signal of which the strength variation is greater than the strength variation threshold.

Herein, the weight corresponding to each wireless signal is intended to indicate the probability that someone is in the vicinity of the screen when the strength variation of the corresponding wireless signal is greater than the strength variation threshold.

Before step 308, a relationship between the identifier of the wireless signal and the corresponding weight may be acquired by correspondingly storing the identifier of the wireless signal and the corresponding weight. Step 308 may include: the identifier of the target wireless signal is adopted and the corresponding weight of the target wireless signal is obtained by inquiry according to the relationship between the identifier of the target wireless signal and the weight, herein, the target wireless signal is the wireless signal of which the strength variation is greater than the strength variation threshold.

For example, when the wireless signal is a WiFi signal, the SSID of each WiFi signal and the weight may be correspondingly stored, such that after identifying that the strength variation of a certain WiFi signal is greater than the corresponding strength variation threshold, the corresponding weight may be acquired by inquiry according to the SSID of the WiFi signal.

The related contents of steps 305 to 308 may be referenced to steps 201 to 204, which are not elaborated herein.

In step 309, the screen is controlled to be in an on state or an off state according to the sum of the calculated weights.

The related content of step 308 may be referenced to step 205, which is not elaborated herein.

In some embodiments, at ordinary times and under the condition that no one is approaching, the electronic device may collect a radio frequency signal, such as a signal at a WiFi access point, in the environment by an existing radio frequency circuit such as a WiFi module, and records the SSID and the signal strength of each access point. In general, the signal strength accords with Gaussian distribution; therefore, a mathematical expectation value 1 and a mean square deviation 1 corresponding to each radio frequency signal may be calculated according to the recorded data (the signal strength of each radio frequency signal), and a confidence degree of the corresponding radio frequency signal according to the mathematical expectation value 1 and the mean square deviation 1. Alternatively, a mathematical expectation value 1 and a mean square deviation 1 corresponding to each radio frequency signal may further be calculated, and a confidence degree of the corresponding radio frequency signal may be calculated according to the mathematical expectation value 1 and the mean square deviation 1.

In some embodiments, when a person actively turns on the screen and interacts with the screen, the state that someone is approaching to the screen may be calculated, the current radio frequency signal may be collected, and the SSID and the signal strength corresponding to each radio frequency signal may be recorded; and for each radio frequency signal, the collected signal strength may be compared with the mathematical expectation value corresponding to the radio frequency signal, and the signal strength of the radio frequency signal may be stored in the case where a difference value between the signal strength and the mathematical expectation value is greater than a predetermined strength variation threshold, wherein the strength variation threshold is calculated by the mathematical expectation value 1 and the mean square deviation 1 corresponding to the radio frequency signal, the strength variation threshold may be predetermined to have over 95% of probability of falling into a Gaussian distribution region, at this time, the threshold is twice the mean square deviation 1 (or called a strength standard deviation 1), and a square of the strength standard deviation 1 or the mean square deviation 1 is equal to mean square deviation 1. It should be noted that detection sensitivity and false trigger probability are affected by predetermination of the strength variation threshold, the higher the sensitivity is, the more likely false trigger is to occur.

A mathematical expectation value 2 and a mean square deviation 2 corresponding to each radio frequency signal is calculated according to the recorded signal strength of each radio frequency signal under the condition that someone is approaching, and a normalized weight is calculated according to the mathematical expectation value 2, the mathematical expectation value 1 and the confidence degree corresponding to each radio frequency signal.

In some embodiments, during actual application, the electronic device may continuously monitor the radio frequency signal in the environment, the corresponding weight is calculated for the radio frequency signal of which the strength variation is greater than the predetermined strength variation threshold when the strength variation of the detected radio frequency signal is greater than the predetermined strength variation threshold, the sum of the weights is acquired by accumulating the calculated weights, and it is identified that the screen should be turned on in response to identifying the sum of the weights is greater than a predetermined weight threshold, wherein the weight threshold may be a fixed constant, for example 0.6, may be calculated during factory debugging.

Therefore, the electronic device may realize personnel detection without the support of an additional sensor, by an existing radio frequency circuit such as a WiFi module and by identifying the signal strength variation of a router or the like in the environment, thereby automatically controlling the state of a display screen.

In addition, in the case where a display device is provided with infrared, laser and millimeter wave sensors, or is provided with a sensor group (such as a microphone group) for collecting audio information in the environment, the state that there is someone or no one in the vicinity of the screen in the second point is labeled (for example, whether there is someone in the vicinity of the screen is identified) by the information collected by the sensors or the information collected by the sensor group, thereby acquiring more accurate data and improving the accuracy of on control.

Based on the method for controlling the screen state according to the embodiment of the present disclosure, the screen state may be automatically controlled without configuring a related sensor. Therefore, the cost may be reduced, the method for controlling the screen may be enriched, and the applicability of the method may be improved or the adaptability of screen control may be enhanced.

Figure 4:
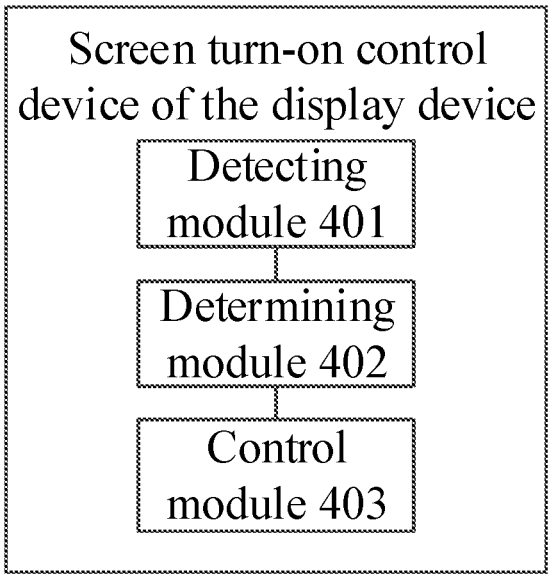
FIG. 4 is a schematic structural diagram of a device for controlling a screen state of an electronic device according to an embodiment of the present disclosure.

The disclosure further provides a device for controlling a screen state. FIG. 4 is a schematic structural diagram of a device for controlling a screen state according to an embodiment of the present disclosure.

As shown in FIG. 4, the device for controlling the screen state includes: a detecting module 401, a calculating module 402, and a control module 403.

The detecting module 401 is configured to detect a signal strength of at least one wireless signal at a position of the screen; the calculating module 402 is configured to calculate a strength variation of the signal strength of the wireless signal relative to a reference signal strength of the wireless signal; and the control module 403 is configured to control the screen to be in an on state or an off state according to the strength variation.

In some embodiments, the control module 403 includes: a determination sub-module, configured to inquire and acquire a weight corresponding to the target wireless signal by an identifier of a target wireless signal and according to a relationship between the identifier of the target wireless signal and the weight, wherein the target wireless signal is a wireless signal, of which the strength variation is greater than a strength variation threshold, of the at least one wireless signal, and each weight is intended to indicate a probability that a target object is present in the vicinity of the screen in the case where the strength variation of the corresponding wireless signal is greater than the strength variation threshold; and a control sub-module, configured to control the screen to be in an on state or an off state according to the calculated weight.

Optionally, the control sub-module is configured to control the screen state by at least one of: controlling the screen to be in the on state in response to identifying the sum of the calculated weights is greater than the weight threshold; or controlling the screen to be in the off state in response to identifying the sum of the calculated weights is not greater than the weight threshold; or controlling the screen to be in the off state in response to identifying the sum of the calculated weights is not greater than the weight threshold within a predetermined duration and the screen is in the open state within the predetermined duration.

In some embodiments, the control module 403 is further configured to: calculate a first mathematical expectation value and a first mean square deviation of the signal strength of each wireless signal detected under the condition that no target object is present within a predetermined range around the screen; calculate a confidence degree of the corresponding wireless signal according to the first mathematical expectation value and the first mean square deviation, wherein the confidence degree is directly proportional to the first mathematical expectation value and is inversely proportional to the first mean square deviation; calculate a second mathematical expectation value of the signal strength of each wireless signal detected under the condition that a target object is present within a predetermined range around the screen; and calculate a weight of the corresponding wireless signal according to a difference value between the second mathematical expectation value and the first mathematical expectation value as well as the confidence degree of the corresponding wireless signal to acquire a corresponding relationship between the identifier and the weight of the wireless signal.

In some embodiments, the control module 403 is further configured to: normalize the weight of each wireless signal after calculating the weight of the corresponding wireless signal according to the difference value between the second mathematical expectation value and the first mathematical expectation value of each wireless signal as well as the confidence degree of the corresponding wireless signal.

In some embodiments, the control module 403 is further configured to perform at least one of the following steps: calculating the second mathematical expectation value of each detected wireless signal in response to an interaction operation received by the smart mirror, wherein the interaction operation indicates that a target object is present within a predetermined range around the screen; and calculating the second mathematical expectation value of each detected wireless signal in response to a detection signal output by a detection device, wherein the detection signal is intended to indicate that a target object is present within a predetermined range around the screen.

In some embodiments, the control module 403 is further configured to: record a product of the first mean square deviation of each wireless signal and a predetermined multiple as a strength variation threshold of the corresponding wireless signal, wherein the first mean square deviation is a mean square deviation of the strength of the corresponding wireless signal under the detected state that no target object is present within a predetermined range around the screen. Optionally, the value of the predetermined multiple may be 1 or 2.

In some embodiments, the reference signal strength meets any one of the following conditions: the reference signal strength is preconfigured; and the reference signal strength is a mathematical expectation value of the signal strength of the wireless signal detected under the condition that no target object is present within a predetermined range around the screen.

It should be noted that the above explanation of the method for controlling the screen state of the electronic device according to the embodiment is also applicable to the device for controlling the screen state of the electronic device according to the embodiment. The details are not elaborated herein.

Based on the device for controlling the screen state according to the embodiment of the present disclosure, a strength variation of the signal strength of the wireless signal relative to the reference signal strength of the wireless signal is calculated according to the strength of the wireless signal detected at the position of the screen, and the screen state of the screen is controlled according to the strength variation. Therefore, the screen can be automatically controlled without configuring an additional related sensor, such that cost may be reduced, the method for controlling the screen may be enriched, and the applicability of the method may be improved or the applicability of screen control may be enhanced.

Figure 5:
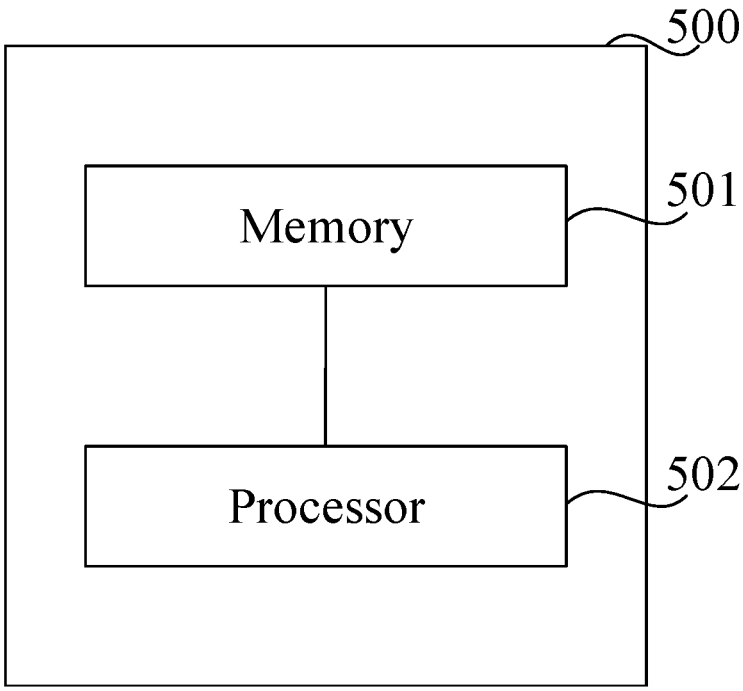
FIG. 5 is a schematic structural diagram of a device for controlling a screen state of an electronic device according to an embodiment of the present disclosure.

The present disclosure further provides a device for controlling a screen state. FIG. 5 is a schematic structural diagram of a device for controlling a screen state according to an embodiment of the present disclosure. As shown in FIG. 5, the device for controlling a screen state of an electronic device includes: a memory 501 and a processor 502, wherein the processor and the memory are electrically connected; at least one instruction executable by the processor is stored in the memory; and when the at least one instruction is executed by the processor, the processor is configured to perform the method for controlling the screen state according to the above embodiment of the present disclosure.

Those skilled in the art may understand that a structure of a screen control device 500 shown in FIG. 5 does not constitute a limitation to the screen control device 500, and in the actual application, the device may include more or fewer components than those shown in the figure, or a combination of some components, or different component arrangement. Herein, the memory 501 may be configured to store computer programs and modules, and the memory 501 may mainly include a program storage area and a data storage area, wherein the program storage area may store application programs or the like required by at least one function of the operating system. The memory 501 may include a high-speed random access memory, and may further include nonvolatile memories, such as at least one disk memory device, flash memory device, or other volatile solid-state memory devices. Accordingly, the memory 501 may further include a memory controller to allow the processor 502 to access the memory 501.

The processor 502 executes a variety of function applications and performs data processing by running the software programs and modules stored in the memory 501.

The present disclosure further provides an electronic device, including a radio frequency circuit, a screen, a memory and a processor, wherein the processor is electrically connected to the radio frequency circuit, the screen and the memory respectively; at least one instruction executable by the processor is stored in the memory; and when the at least one instruction is executed by the processor, the processor is configured to implement the method for controlling the screen state of the electronic device according to the embodiment of the present disclosure.

For example, the electronic device may be a device with a display function, for example, the electronic device may be hardware devices with various operating systems, touch screens and/or display screens, such as a mobile phone, a tablet computer, a personal digital assistant, a wearable device, or the like; or the electronic device may further be a smart mirror with a display function, such as a bathroom mirror, a hallway mirror, or the like.

Figure 6:
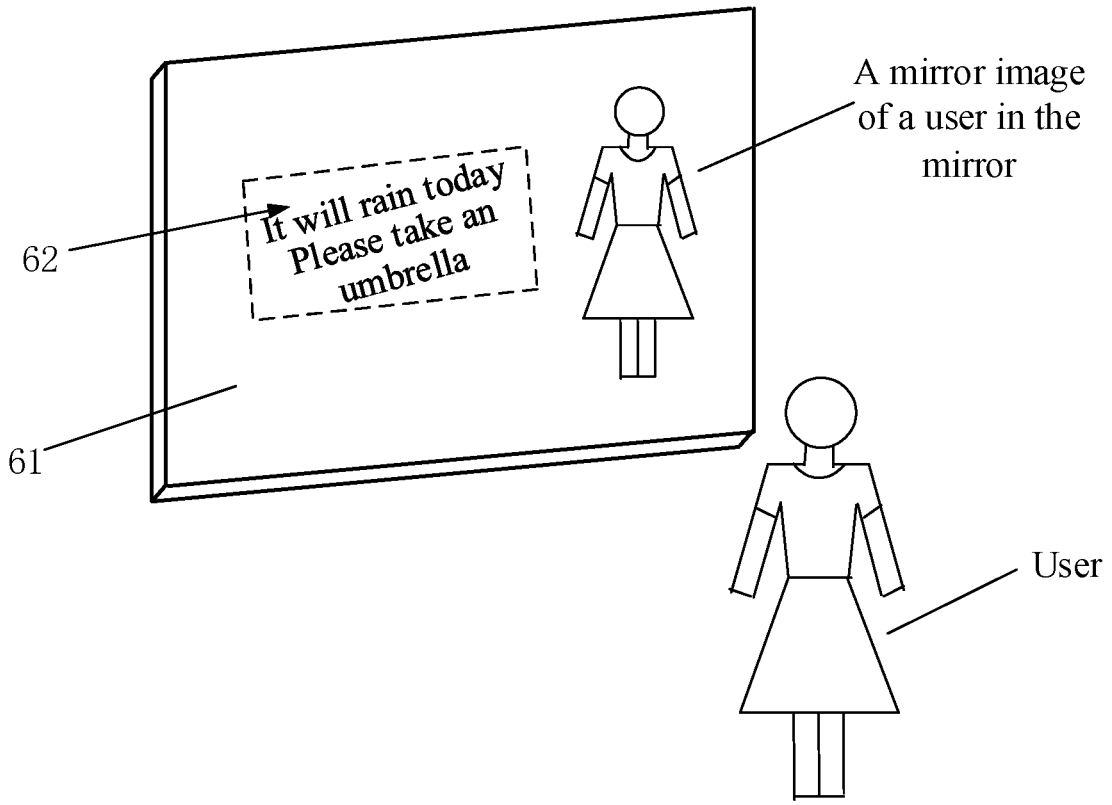
FIG. 6 is a schematic structural diagram of a smart mirror according to an embodiment of the present disclosure.

FIG. 6 is a schematic structural diagram of a smart mirror according to an embodiment of the present disclosure. As shown in FIG. 6, the smart mirror includes a mirror body 61 and a screen 62 located on a back surface of the mirror body. The mirror body has a transflective region (a region shown by a dashed box shown in the figure), and the screen 62 is located in the transflective region. The transflective region has a light-transmissive property, and an image may pass through the mirror body by the transflective region when the screen displays the image, such that a user may observe the image displayed by the screen from a front surface of the mirror body, for example, weather information in FIG. 6: "it will rain today, please take an umbrella". Meanwhile, the transflective region has a reflective property and is configured to image an object in front of the mirror body, thereby achieving an imaging function of an ordinary mirror.

For example, the transflective region may include a transflective film and a transparent substrate. The transflective film includes but not limited to an aluminum film, a silicon oxide film, or the like.

The smart mirror further includes a radio frequency circuit, a memory and a processor. The radio frequency circuit, the memory and the processor are arranged on the mirror body; the processor is electrically connected to the radio frequency circuit, the screen and the memory respectively; at least one instruction executable by the processor is stored in the memory; and when the at least one instruction is executed by the processor, the processor is configured to: acquire a signal strength of at least one wireless signal detected by the radio frequency circuit; calculate a strength variation of the signal strength of the wireless signal relative to a reference signal strength of the wireless signal; and control the screen to be in an on state or an off state according to the strength variation.

The related content that the processor of the smart mirror controls the screen may be referenced to the method for controlling the screen state, and detailed description is not given herein.

As shown in FIG. 6, when a user is located in front of the mirror body of the smart mirror, a mirror image of the user will appear in the mirror body 61. Meanwhile, since the signal strength of the wireless signal detected by the radio frequency circuit has varied greatly relative to the reference signal strength, the processor may control the screen 62 of the smart mirror to be in an on state according to the strength variation of the wireless signal to display the image by the screen 62. When no user is in front of the mirror body 61, the signal strength of the wireless signal detected by the radio frequency circuit is less different from the reference signal strength; therefore, the processor may control the screen 62 of the smart mirror to be in an off state according to the strength variation of the wireless signal, that is, the screen 62 does not display the image.

In order to implement the above embodiment, the present disclosure further provides a non-transitory computer-readable storage medium, in which a computer program is stored, wherein when the program is executed by a processor, the screen turn-on control method of the display device according to the above embodiment of the present disclosure.

In the description of the specification, description of reference terminals "one embodiment" or "an embodiment", "some embodiments", "example", "particular example" or "some examples", or the like means that particular features, structures, materials or characteristics described with reference to the embodiment or the example is included in at least one embodiment or example of the present disclosure. In the present specification, the schematic representation of the above terms does not necessarily mean the same embodiment or example. Furthermore, the particular features, structures, materials, or characteristics described may be combined in a suitable manner in any one or more embodiments or examples. In addition, various embodiments or examples described in the specification, as well as features of various embodiments or examples, may be combined and combined by those skilled in the art without contradicting each other. Besides, the terms "first", "second" are used only for description and shall not be interpreted as an indication or implication of relative importance or an implicit indication of the number of technical features. Thus, features defined with "first", "second" may include at least one such feature, either explicitly or implicitly. In the description of the present disclosure, "a plurality" means at least two, for example, two, three, or the like, unless otherwise specifically defined.

Any process or method described in the flowchart or otherwise described herein may be interpreted as representation of a module, a segment or a portion of a code including one or more executable instructions for implementing a step of customizing a logic function or process; furthermore, a range of preferable implementations of the present disclosures includes another implementations, in which functions may be performed according to the substantially simultaneous manner or in a reverse order other than in the shown or discussed order according to the functions involved, which should be understood by those skilled in the art which embodiments of the present disclosure belong to.

The logic and/or steps represented in the flowcharts or otherwise described herein, for example, may be considered as an ordered list of executable instructions for implementing logical functions, and may be embodied in any computer-readable medium for use by or in combination with an instruction execution system, apparatus, or device (e.g., a computer-based system, a system including a processor, or other system that can fetch instructions from an instruction execution system, apparatus, or device and execute instructions). For the purposes of this specification, a "computer-readable medium" may be any apparatus that may contain, store, communicate, propagate or transmit a program for use in an instruction execution system, apparatus, or device, or in combination with the instruction execution system, apparatus, or device. A more particular example (non-exhaustive list) of the computer-readable medium includes: an electric connection part (electronic device) including one or more wirings, a portable computer disk box (magnetic device), a random access memory (RAM), a read only memory (ROM), an erasable programmable read only memory (EPROM) or a flash memory, an optional fiber device, and a portable optical disk read only memory. In addition, since the program may be acquired electronically, for example by optical scanning of paper or other medium, followed by editing, interpretation or, where necessary, processing in other suitable manner, and then storing it in computer memory, the computer-readable medium may even be a paper or other suitable medium on which the program can be printed.

It should be understood that various parts of the present disclosure may be implemented by hardware, software, firmware or a combination thereof. In the above-described embodiments, multiple steps or methods may be implemented in software or firmware stored in a memory and executed by a suitable instruction execution system. For example, in the case where the multiple steps or methods are implemented by using hardware, similar to another embodiment, the steps or methods may be implemented by using any one or a combination of the following technologies that are commonly known in the art: a discrete logic circuit of a logic gate circuit configured to implement logic function to data signals, an application specific integrated circuit having a suitable combinational logic gate, a programmable gate array (PGA), a field-programmable gate array (FPGA), and the like.

It will be appreciated by those of ordinary skill in the art that all or part of the steps of implementing embodiments of the foregoing method may be performed by hardware related to the program instructions. The program may be stored in a computer-readable storage medium, which, when executed, includes one or a combination of the steps of a method embodiment.

In addition, various functional units in each embodiment of the present disclosure may be integrated in a processing module, each unit may be present physically separately, and two or more units may be integrated in a module. The above integrated module may be implemented in the form of hardware and may also be implemented in the form of a software functional module. The integrated modules may be stored in a computer-readable storage medium in the case of being implemented in the form of the software function module and sold or used as an independent product.

The above-mentioned storage medium may be a read only memory, a magnetic disk or an optical disk or the like. Although the embodiments of the present disclosures have been shown and described above, it may be understood that the above-mentioned embodiments are exemplary and should not be interpreted as a limitation to the present disclosure, and those of ordinary skill in the art may derive modifications, substitutions, and variations based on the above embodiments within the scope of the present disclosure.

What claimed is:

1. A smart mirror, comprising:

a radio frequency circuit, a screen, a memory, and a processor; wherein the processor is electrically connected to the radio frequency circuit, the screen and the memory respectively; at least one instruction executable by the processor is stored in the memory; and when the at least one instruction is executed by the processor, the processor is configured to:

acquire a signal strength of at least one wireless signal detected by the radio frequency circuit;

calculate a strength variation of the signal strength of the wireless signal relative to a reference signal strength of the wireless signal; and control the screen to be in an on state or an off state according to the strength variation;

wherein controlling the screen to be in the on state and the off state according to the strength variation comprises:

calculating a first mathematical expectation value and a first mean square deviation of the signal strength of each wireless signal detected under the condition that no target object is present within a predetermined range around the screen;

calculating a confidence degree of the corresponding wireless signal according to the first mathematical expectation value and the first mean square deviation, wherein the confidence degree is directly proportional to the first mathematical expectation value and is inversely proportional to the first mean square deviation;

calculating a second mathematical expectation value of the signal strength of each wireless signal detected under the condition that a target object is present within a predetermined range around the screen; and calculating a weight of the corresponding wireless signal to acquire a corresponding relationship between the identifier and the weight of the wireless signal according to a difference value between the second mathematical expectation value and the first mathematical expectation value corresponding to each wireless signal as well as the confidence degree of the corresponding wireless signal;

acquiring a weight corresponding to a target wireless signal by query with an identifier of the target wireless signal according to the corresponding relationship between the identifier of the target wireless signal and the weight, wherein the target wireless signal is a wireless signal, of which the strength variation is greater than a strength variation threshold, of the at least one wireless signal, and the weight is intended to indicate a probability that a target object is present in the vicinity of the screen in the case where the strength variation of the corresponding wireless signal is greater than the strength variation threshold; and controlling the screen to be in the on state or the off state according to the calculated weight.

2. The smart mirror according to claim 1, wherein when the number of the target wireless signal is at least two, the processor is further configured to control the screen to be in the on state or the off state by:

controlling the screen to be in the on state in response to identifying that a sum of the calculated weights is greater than a weight threshold;

controlling the screen to be in the off state in response to identifying that the sum of the calculated weights is not greater than the weight threshold; or controlling the screen to be in the off state in response to identifying that the sum of the calculated weights is not greater than a weight threshold within a predetermined duration and the state of the screen is in the on state within the predetermined duration.

3. The smart mirror according to claim 1, wherein the processor is further configured to:

calculate the weight of the corresponding wireless signal according to the difference value between the second mathematical expectation value and the first mathematical expectation value of each wireless signal as well as the confidence degree of the corresponding wireless signal in response to identifying that the difference value between the second mathematical expectation value and the first mathematical expectation value is greater than a strength variation threshold of the corresponding wireless signal.

4. The smart mirror according to claim 1, wherein the processor is further configured to:

normalize the weight of each wireless signal after calculating the weight of the corresponding wireless signal according to the difference value between the second mathematical expectation value and the first mathematical expectation value of each wireless signal as well as the confidence degree of the corresponding wireless signal.

5. The smart mirror according to claim 1, wherein the processor is further configured to perform at least one of the following steps:

calculating the second mathematical expectation value of each detected wireless signal in response to an interaction operation received by the smart mirror, wherein the interaction operation indicates that a target object is present within a predetermined range around the screen; and calculating the second mathematical expectation value of each detected wireless signal in response to a detection signal output by a detection device, wherein the detection signal is intended to indicate that a target object is present within a predetermined range around the screen.

6. The smart mirror according to claim 1, wherein the processor is further configured to:

record a product of the first mean square deviation of the signal strength of each wireless signal and a predetermined multiple as a strength variation threshold of the corresponding wireless signal, wherein the first mean square deviation is a mean square deviation of the strength of the corresponding wireless signal detected under the condition that no target object is present within a predetermined range around the screen.

7. The smart mirror according to claim 1, wherein the reference signal strength meets any one of the following conditions:

the reference signal strength is preconfigured; and the reference signal strength is a mathematical expectation value of the signal strength of the wireless signal detected under the condition that no target object is present within a predetermined range around the screen.

8. A device for controlling a screen state of an electronic device, comprising a memory and a processor, wherein at least one instruction executable by the processor is stored in the memory; and when the at least one instruction is executed by the processor, the processor is configured to:

detect a signal strength of at least one wireless signal at a position of the screen;

calculate a strength variation of the signal strength of the wireless signal relative to the reference signal strength of the wireless signal; and control the screen to be in an on state or an off state according to the strength variation;

wherein controlling the screen to be in the on state and the off state according to the strength variation comprises:

calculating a first mathematical expectation value and a first mean square deviation of the signal strength of each wireless signal detected under the condition that no target object is present within a predetermined range around the screen;

calculating a confidence degree of the corresponding wireless signal according to the first mathematical expectation value and the first mean square deviation, wherein the confidence degree is directly proportional to the first mathematical expectation value and is inversely proportional to the first mean square deviation;

calculating a second mathematical expectation value of the signal strength of each wireless signal detected under the condition that a target object is present within a predetermined range around the screen; and calculating a weight of the corresponding wireless signal to acquire a corresponding relationship between the identifier and the weight of the wireless signal according to a difference value between the second mathematical expectation value and the first mathematical expectation value corresponding to each wireless signal as well as the confidence degree of the corresponding wireless signal;

acquiring a weight corresponding to a target wireless signal by query with an identifier of the target wireless signal according to the corresponding relationship between the identifier of the target wireless signal and the weight, wherein the target wireless signal is a wireless signal, of which the strength variation is greater than a strength variation threshold, of the at least one wireless signal, and the weight is intended to indicate a probability that a target object is present in the vicinity of the screen in the case where the strength variation of the corresponding wireless signal is greater than the strength variation threshold; and controlling the screen to be in the on state or the off state according to the calculated weight.

9. The device according to claim 8, wherein when the number of the target wireless signal is at least two, the processor is further configured to control the screen to be in the on state or the off state by:

control the screen to be in the on state in response to identifying that a sum of the calculated weights is greater than a weight threshold;

control the screen to be in the off state in response to identifying that the sum of the calculated weights is not greater than the weight threshold; or control the screen to be in the off state in response to identifying that the sum of the calculated weights is not greater than the weight threshold within a predetermined duration and the screen is in the on state within the predetermined duration.

10. The device according to claim 8, wherein the processor is further configured to:

record a product of the first mean square deviation of each wireless signal and a predetermined multiple as a strength variation threshold of the corresponding wireless signal; wherein the first mean square deviation is a mean square deviation of the strength of the corresponding wireless signal detected under the condition that no target object is present within a predetermined range around the screen.

11. A method for controlling a screen state of an electronic device, comprising:

detecting a signal strength of at least one wireless signal at a position of the screen;

calculating a strength variation of the signal strength of the wireless signal relative to the reference signal strength of the wireless signal; and controlling the screen to be in an on state or an off state according to the strength variation;

wherein controlling the screen to be in the on state and the off state according to the strength variation comprises:

calculating a first mathematical expectation value and a first mean square deviation of the signal strength of each wireless signal detected under the condition that no target object is present within a predetermined range around the screen;

calculating a confidence degree of the corresponding wireless signal according to the first mathematical expectation value and the first mean square deviation, wherein the confidence degree is directly proportional to the first mathematical expectation value and is inversely proportional to the first mean square deviation;

calculating a second mathematical expectation value of the signal strength of each wireless signal detected under the condition that a target object is present within a predetermined range around the screen; and calculating a weight of the corresponding wireless signal to acquire a corresponding relationship between the identifier and the weight of the wireless signal according to a difference value between the second mathematical expectation value and the first mathematical expectation value corresponding to each wireless signal as well as the confidence degree of the corresponding wireless signal;

acquiring a weight corresponding to a target wireless signal by query with an identifier of the target wireless signal according to the corresponding relationship between the identifier of the target wireless signal and the weight, wherein the target wireless signal is a wireless signal, of which the strength variation is greater than a strength variation threshold, of the at least one wireless signal, and the weight is intended to indicate a probability that a target object is present in the vicinity of the screen in the case where the strength variation of the corresponding wireless signal is greater than the strength variation threshold; and controlling the screen to be in the on state or the off state according to the calculated weight.

12. The method according to claim 11, wherein when the number of the target wireless signal is at least two, controlling the screen to be in the on state or the off state according to the calculated weight comprises:

controlling the screen to be in the on state in response to identifying a sum of the calculated weights is greater than a weight threshold;

controlling the screen to be in the off state in response to identifying the sum of the calculated weights is not greater than the weight threshold; or controlling the screen to be in the off state in response to identifying the sum of the calculated weights is not greater than the weight threshold within a predetermined duration and the screen is in the one state within the predetermined duration.

* * * * *